US008215345B2

(12) United States Patent
Clever

(10) Patent No.: US 8,215,345 B2
(45) Date of Patent: Jul. 10, 2012

(54) FUEL FLOW SHAPER

(75) Inventor: Bryan William Clever, Liberty Township, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 651 days.

(21) Appl. No.: 12/339,940

(22) Filed: Dec. 19, 2008

(65) Prior Publication Data

US 2010/0154923 A1 Jun. 24, 2010

(51) Int. Cl.
*B65B 1/04* (2006.01)

(52) U.S. Cl. ..... 141/286; 141/392; 239/504; 222/566; 222/575

(58) Field of Classification Search ..... 141/392, 141/285, 286, 206, 255, 311 A, 310; 239/504, 239/590, 590.5, 462, 499, 518, 522, 523, 239/524; 222/247, 566, 571–573, 575
See application file for complete search history.

(56) References Cited

U.S. PATENT DOCUMENTS

| | | | | |
|---|---|---|---|---|
| 597,842 | A | 1/1898 | Edmands | |
| 2,627,439 | A * | 2/1953 | Wornall | 239/539 |
| 2,874,735 | A | 2/1959 | Boone | |
| 3,126,925 | A | 3/1964 | Boone | |
| 3,486,700 | A | 12/1969 | Bristow | |
| 3,556,410 | A | 1/1971 | Arant | |
| 3,840,051 | A * | 10/1974 | Akashi et al. | 138/37 |
| 3,841,568 | A * | 10/1974 | Broad | 239/590 |
| 4,204,563 | A | 5/1980 | Pyle | |
| 4,351,375 | A | 9/1982 | Polson | |
| 4,809,753 | A | 3/1989 | Fink, Jr. | |
| 4,848,672 | A | 7/1989 | Matsumoto et al. | |
| 5,141,037 | A | 8/1992 | Carmack et al. | |
| 5,327,945 | A | 7/1994 | Simpson et al. | |
| 5,645,115 | A | 7/1997 | Kesterman et al. | |
| 5,762,117 | A * | 6/1998 | Law | 141/198 |
| 5,765,609 | A | 6/1998 | Dalhart et al. | |
| 5,779,099 | A * | 7/1998 | D'Andrade | 222/79 |
| 6,024,140 | A | 2/2000 | Garrison et al. | |
| 6,290,149 | B1 | 9/2001 | Daniel, III et al. | |
| 6,634,388 | B1 | 10/2003 | Taylor et al. | |
| 6,676,029 | B2 | 1/2004 | Mitchell | |
| 6,951,229 | B2 * | 10/2005 | Garrison et al. | 141/206 |
| 2005/0040260 | A1 * | 2/2005 | Zhao et al. | 239/548 |
| 2005/0072866 | A1 * | 4/2005 | Petit | 239/590 |

FOREIGN PATENT DOCUMENTS

| | | |
|---|---|---|
| EP | 0026727 | 4/1981 |

OTHER PUBLICATIONS

OPW Fueling Components Group Bulletin, vol. 9, No. 1 (Feb./Mar. 1989).
OPW "Flow Lock Spout" brochure (Jun. 2, 1989).
European Search Report, European Application No. 09178054.4; 7 pages (May 6, 2010).

* cited by examiner

*Primary Examiner* — Timothy Maust
*Assistant Examiner* — Timothy Kelly
(74) *Attorney, Agent, or Firm* — Thompson Hine L.L.P.

(57) ABSTRACT

A fuel dispensing nozzle system including a spout configured to dispense fuel flowing therethrough, and a flow shaper positioned in the spout such that fuel flowing through the spout passes through the flow shaper. The flow shaper includes a central cavity and a plurality of outer cavities positioned about the central cavity. The central cavity and the plurality of outer cavities each have a L/D ratio, wherein the L/D ratio of the central cavity is less than the L/D ratio of each of the outer cavities.

19 Claims, 7 Drawing Sheets

FUEL FLOW SHAPER

The present invention is directed to a device for aligning fluid flow, and more particularly, a device for aligning the flow of fuel through a nozzle dispenser.

BACKGROUND

Fuel dispensers are widely utilized to dispense fuels, such as gasoline, diesel, biofuels, blended fuels or the like, into the fuel tank of a vehicle. Many fueling nozzles include obstructions in the flow path that induce turbulence, vortices, and other turbulent eddy flows. For example, passages in the nozzle body, the interface between the nozzle body and the spout, and components in the spout such as an attitude device, sensing tube and sensing tube fitting may present obstructions. Regulatory recommendations and industry standards limit the length of the spout, and therefore the fuel is typically unable to dissipate the effects of these obstructions and reach a uniform flow pattern prior to exiting the spout.

The turbulent flow of fuel exiting the nozzle can present various difficulties. For example, many nozzles utilize an automatic shut-off device which includes a sensing port positioned near the end of the spout. A poor spray pattern of fuel exiting the nozzle can cause splash back of the fuel from the walls of the vehicle fill pipe. The splash back can reach the sensing port of the shut-off device, thereby causing nuisance shut offs. Existing fuel dispensers may also allow fluid to wick upwardly along the underside of the spout, which can also cause nuisance shut offs.

Turbulent flow and/or poor spray patterns of fuel exiting the nozzle can also affect the performance of the system when refueling vehicles which include an onboard refueling vapor recovery ("ORVR") system. In particular, liquid seal ORVR systems are typically designed such that the vehicle fill pipe has a progressively reduced inner diameter. This configuration is provided so that fuel flowing into the fill pipe can cover or extend continuously across the cross section of the fill pipe, during refueling, to form a liquid seal which prevents fuel vapor from escaping through the fill pipe. The reduction in diameter of the fill pipe also causes a vacuum to be generated during refueling due to the venturi effect of the entering fuel stream.

Many fuel dispensers are configured to capture vapors emitted from a vehicle fuel tank during refueling, and return the vapors to the underground fuel storage tank. For example, stage II vacuum assist vapor recovery systems utilize a vapor pump to capture vapor and return the captured vapor through a vapor path of the fuel dispenser back to the ullage space of the underground fuel storage tank. Many stage II vacuum assist vapor recovery systems are configured to detect an ORVR-equipped vehicle, and cease operation of the vapor pump upon detection of an ORVR-equipped vehicle (i.e., if a vacuum is detected at the point of refueling, or at the end of the nozzle).

However, if fuel flow exiting the nozzle has sufficient turbulence and/or an undesirable spray pattern, the flow stream may jet toward the narrowed neck of an ORVR fill pipe in a non-uniform manner. In this case, the fuel may fail to extend continuously across the cross section of the fill pipe, which can cause the vehicle ORVR system to fail to generate a sufficient vacuum at the point of refueling. The fuel dispenser may thus fail to identify an ORVR-equipped vehicle as such. In this case, the vacuum pump of the fuel dispenser may continue to operate, which causes fresh air to be draw into the ullage space of the underground fuel storage tank. This fresh air causes excessive evaporation of the volatile fuels in the storage tank, which can cause pollutants to be released into the atmosphere by venting.

SUMMARY

In one embodiment the invention is a nozzle system in which turbulence of the exiting fuel stream is reduced and improved spray patterns are provided. In particular, in one embodiment, the invention is a fuel dispensing nozzle system including a spout configured to dispense fuel flowing therethrough, and a flow shaper positioned in the spout such that fuel flowing through the spout passes through the flow shaper. The flow shaper includes a central cavity and a plurality of outer cavities positioned about the central cavity. The central cavity and the plurality of outer cavities each have a L/D ratio, wherein the L/D ratio of the central cavity is less than the L/D ratio of each of the outer cavities.

DETAILED DESCRIPTION

Figure 1:
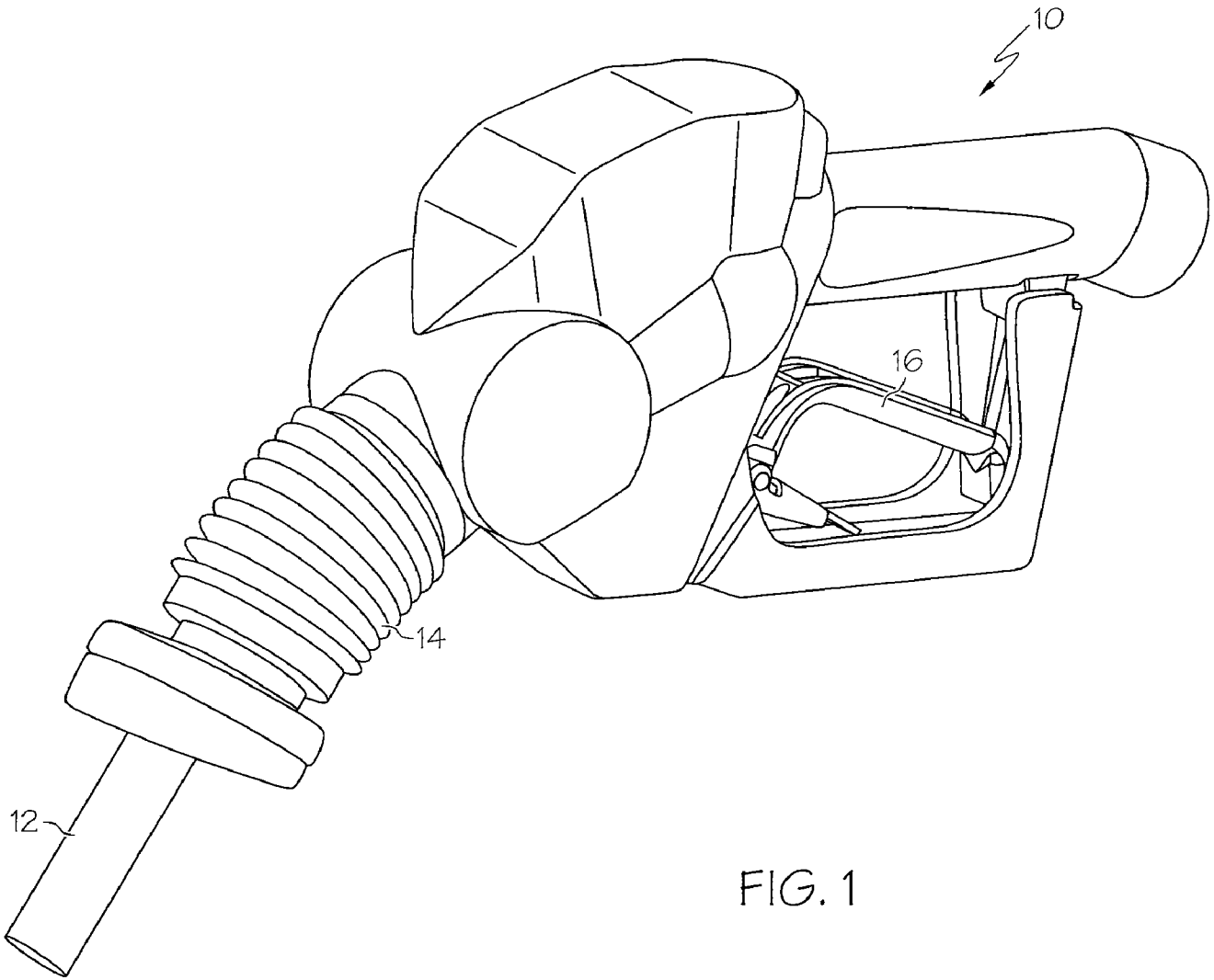
FIG. 1 is a front perspective view of a nozzle.

FIG. 1 illustrates a nozzle or dispenser body 10 configured to be inserted into the fill pipe of a vehicle fuel tank. Fuel is pumped from an underground fuel storage tank to the nozzle 10, through the spout 12 and into the fill pipe of the vehicle fuel tank. The nozzle 10 may include an optional vapor boot or bellows 14 which surrounds an upper end of the spout 12 to aid in vapor recovery. The nozzle 10 includes a lever 16 coupled to a main vapor valve and a main fuel valve (not shown) such that when the lever 16 is gripped and pivoted upwardly, the main valves are correspondingly opened, thereby allowing the flow of fuel and vapor through fuel and vapor paths of the nozzle 10, respectively.

Figure 2:
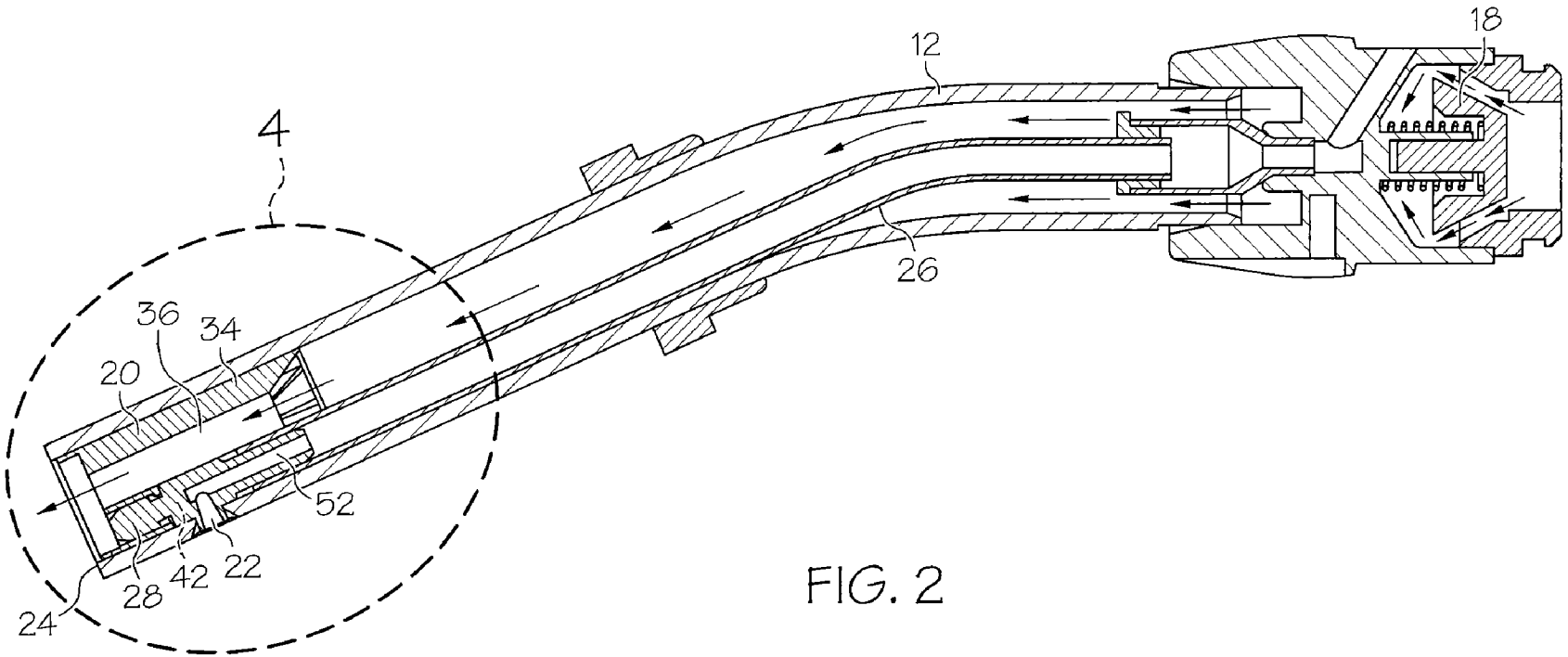
FIG. 2 is a side cross section of the spout of the nozzle of FIG. 1.
Figure 3:
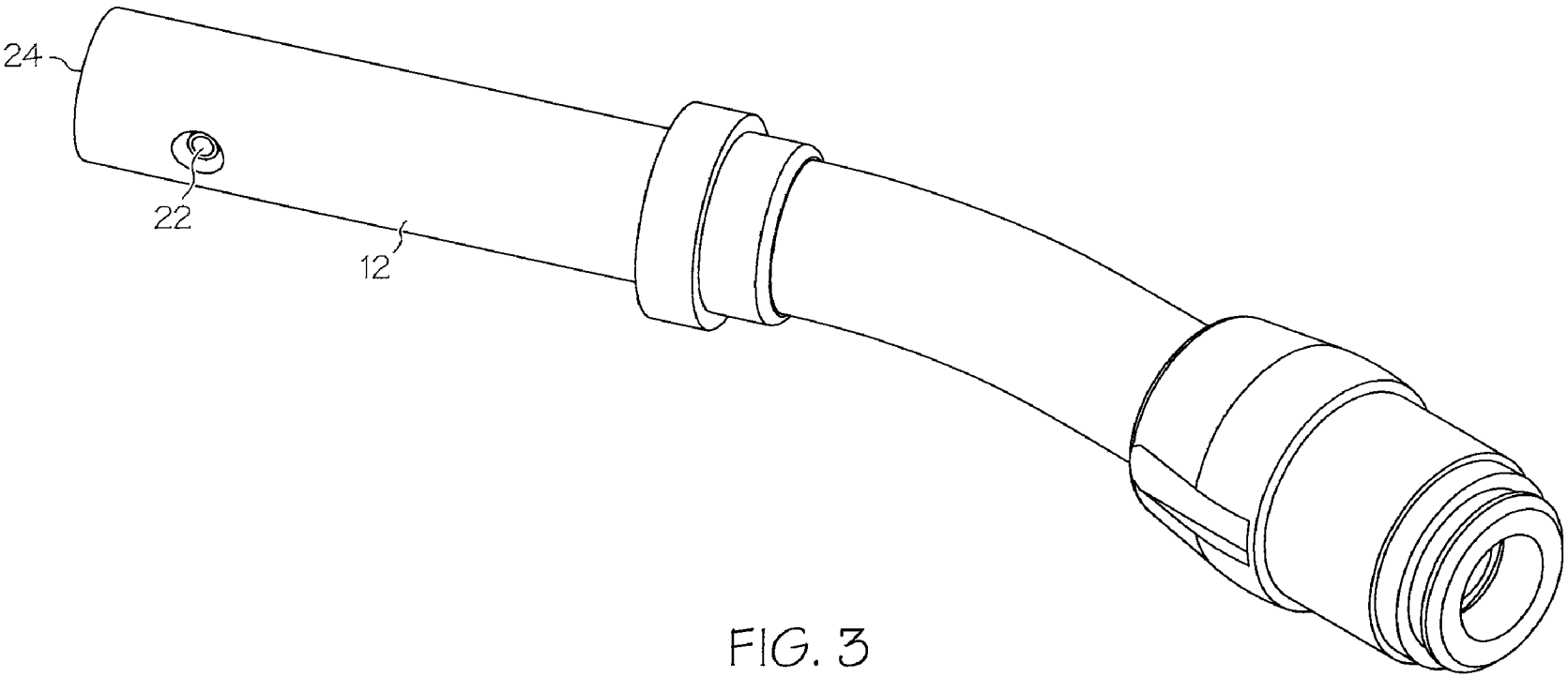
FIG. 3 is a front perspective view of the spout of FIG. 2.

As shown in FIG. 2, fuel which enter the nozzle 10 flows past a check valve 18, along the length of the spout 12 and passes through a flow shaper 20 positioned at or near the end of the spout 12. The spout 12 may have a shut-off opening or sensing port 22 formed therethrough. In the illustrated embodiment, the sensing port 22 is positioned on an underside of the spout 12, near the tip 24 of the spout 12. The sensing port 22 is in fluid communication with a tube 26 via a tube fitting 28, as will be described in greater detail below.

The tube 26 is positioned in the spout 12, and an upstream end of the tube 26 is fluidly coupled to a shut-off device or circuit (not shown) which compares the pressure in the sensing port 22 to the dynamic pressure generated by a venturi effect of flowing fuel in the nozzle 10. When the differential pressure becomes sufficiently great, the shut-off circuit causes a shut-off mechanism to release the lever 16 and close the main fuel and main vapor valves, thereby interrupting the fueling process. For example, when the sensing port 22 is temporarily blocked or closed (i.e., due to foam or splash back of liquid fuel) the vacuum levels in the shut-off circuit significantly increase, thereby triggering the shut-off mechanism.

Accordingly, as noted above, splash back of fuel during the refueling process can land on the sensing port 22, thereby triggering shut off before the vehicle fuel tank is full. These nuisance or premature shut offs require the customer/operator to re-engage the nozzle 10 and lever 16, thereby adding wear and tear on the refueling components, and causing aggravation to the customer/operator.

The flow shaper 20 helps to align and straighten the flow, remove turbulence, and ensure a relatively straight and consistent flow of fuel exiting the spout 12. As best shown in FIGS. 5A-5D, the flow shaper 20 includes an outer wall 30 and an inner wall 32 which is entirely radially spaced away from the outer wall 30, and generally concentrically positioned with respect to the outer wall 30. In the illustrated embodiment, both the outer 30 and inner walls 32 are generally cylindrical. However, the outer wall 30 may take on various shapes as desired to conform to the inner surface of the spout 12, and the inner wall 32 can also take various shapes as desired.

The flow shaper 20 includes a plurality of generally flat vanes 34 extending generally radially between the outer 30 and inner 32 walls. In this manner, the flow shaper 20, and in particular, the inner wall 32, defines an inner cavity or channel 36. The outer wall 30, inner wall 32 and vanes 34 define a plurality of outer cavities or channels 38 that generally surround and/or extend generally radially around the inner cavity 36. In particular, the outer cavities 38 may surround and/or extend radially around at least a majority of the perimeter of the inner cavity 36 (i.e. at least about 270 degrees in the illustrated embodiment).

During fuel dispensing, fluid flowing down the spout 12 enters the central cavity 36 and each outer cavity 38. The upstream surface of the walls 30, 32 and vanes 34 physically redirect the fuel flow into the cavities 36, 38, thereby dividing the flow into a plurality of discrete streams.

Each outer cavity 38 may be designed to provide a fully developed profile, or fully developed flow, for fluid exiting that cavity 38. In other words, the flow exiting each outer cavity 38 may have a uniform (i.e., stable) velocity profile such that the velocity profile for fluid exiting the outer cavity 38 is the same as a velocity profile for fluid just upstream of the exit location.

Each of the cavities 36, 38 may have a L/D ratio, which represents a ratio of the length of the cavity 36, 38 to its hydraulic or effective diameter. The hydraulic diameter of each cavity 36, 38 represents the diameter of a tubular/cylindrical component which provides the equivalent surface area/drag as that particular non-cylindrical cavity 36, 38. The L/D ratio for each of the outer cavities 38 may be selected to ensure that fuel flow exiting from that cavity 38 is fully developed. In particular, although the L/D ratio can vary depending upon the type of fluid, flow conditions and the like, classical fluid dynamic equations and experimentation has shown in normal operating conditions (i.e., in one case, for gasoline with a temperature range of 0° F. to 120° F.), for incompressible fluids and liquid fuels, a L/D ratio of at least about 7:1, or more particularly at least about 10:1, is sufficient to provide fully developed flow. This ratio does not depend upon the velocity of the fuel flow, but assumes that fluid flow fills the cross sectional area of each cavity 36, 38 (i.e. throughout the flow domain) to be able to become fully developed. In addition, the ratio may depend upon the viscosity of the fluid, which can vary for different types of fuel, varying temperatures, etc. For example, for use with ethanol, a L/D ratio of at least about 5:1 may suffice. However, a 10:1 ratio has been found to be sufficient for a wide variety of fuels under various conditions.

As flow first enters a cavity 38, frictional forces from the walls 30, 32, 34 of the cavity 38 are applied only to outermost portions of that fluid stream, adjacent to the walls 30, 32, 34. For a 10:1 ratio scenario, by the by the time fluid has traveled ten times the hydraulic or effective diameter of a cavity 38, the frictional forces imparted by the walls 30, 32, 34 of the cavity 38 are sufficient to reach the center, or all, of the fluid in that cavity 38. In this case, the walls 30, 32, 34 have exerted frictional forces upon all fluid exiting that cavity 38 and provide a fully developed flow, thereby increasing stability and reducing turbulence of the flow. Thus, the surface area of the outer cavities 38 produce sufficient pressure drop, as the fluid passes therethrough, to cause tumbling and rotary vortices elements of the flow to become reduced or eliminated.

The embodiment shown in FIGS. 5A-5D includes six outer cavities 38. However, the number of cavities 38 can be reduced if the length of the cavities 38/flow shaper 20 were to be increased. Correspondingly, the length of the cavities 38/flow shaper 20 can be reduced if the number of cavities 38 were to be increased. Thus the number of outer cavities 38 does not govern performance, but instead the exposure of the flow to the drag forces of the walls of the cavities 38, which dissipates the turbulent energy, determines the performance of the cavities 38. The added pressure drop as fluid travels through the cavities 38 provides the energy needed to produce fully developed fluid flow.

Thus, it can be seen that fluid exiting each outer cavity 38 may be fully developed. However, due to the increased effective diameter of the central cavity 36, in one embodiment fluid exiting the central cavity 36 may not be fully developed (and may have a lower velocity than the surrounding fluid). For example, in one embodiment the L/D ratio for the central cavity 36 may be less than about 10:1, such as about 5:1. However, because the fluid exiting the outer cavities 38 generally surrounds and "encapsulates" the majority of the fluid exiting the central cavity 36 (i.e. at least about 270 degrees in the illustrated embodiment), a stable outer ring of fluid generally entraps the less developed coaxial inner core of fluid and significantly prevents any diverging fluid streams. As the flow exits the spout 12, the individual streams from the cavities 36, 38 will eventually merge and become a coherent single stream, ultimately with a uniform velocity profile. Thus, the outer ring of fully-developed fluid ensures that the exiting stream, as a whole, has a stable, circular spray pattern with a very low angle of divergence and little turbulence. The flow shaper 20 may be positioned close to the end 24 of the spout 12 (i.e. within at least about the distance of the diameter, or effective diameter, of the spout 12 from the end 24) so that the flow shaper 20 can influence the exiting flow in the desired manner.

It may be possible to provide a shaper 20 in which all streams exiting the shaper 20 are fully developed. For example, the length of the shaper 20 may be increased, and/or the size of the central cavity 36 reduced, such that fluid exiting all cavities 36, 38 is fully developed. However, if only the outer part of the flow is fully developed, this may help to reduce pressure drop across the spout 12. In particular, if all of the fluid exiting the spout 12 were to be fully developed, this would generate a significant pressure drop across the spout 12. This pressure drop could render the spout 12 more prone to premature automatic shut offs, since the fluid flow through the upstream venturi path will be slower, thereby generating a lower vacuum pressure. In this case, the measured vacuum pressure differential by the shut off circuit would be lowered. In contrast, if the flow shaper 20 does not fully develop all of the fluid, but only the more critical outer streams, the pressure drop across the flow shaper 20 is reduced, thereby ensuring proper operation of the nozzle 10 and avoiding premature shut offs.

Figure 5A:
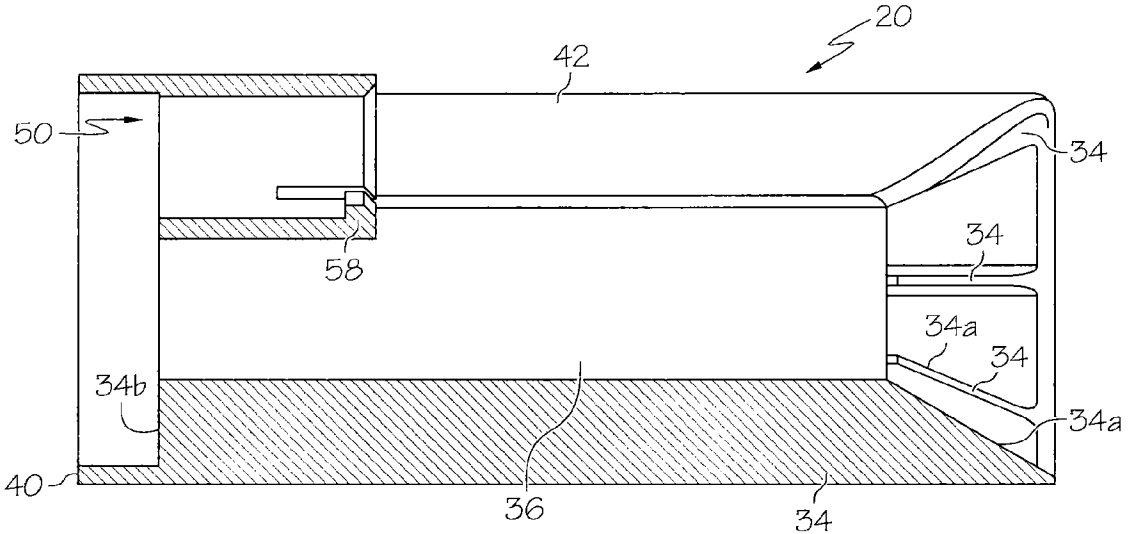
FIG. 5A is a side cross section of the flow shaper of FIGS. 2 and 4.
Figure 5B:
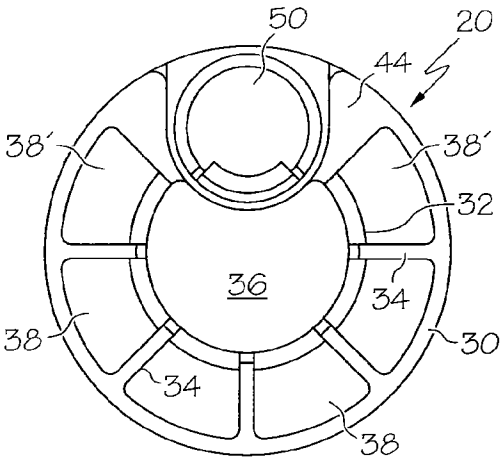
FIG. 5B is an end view of the flow shaper of FIG. 5A.
Figure 5C:
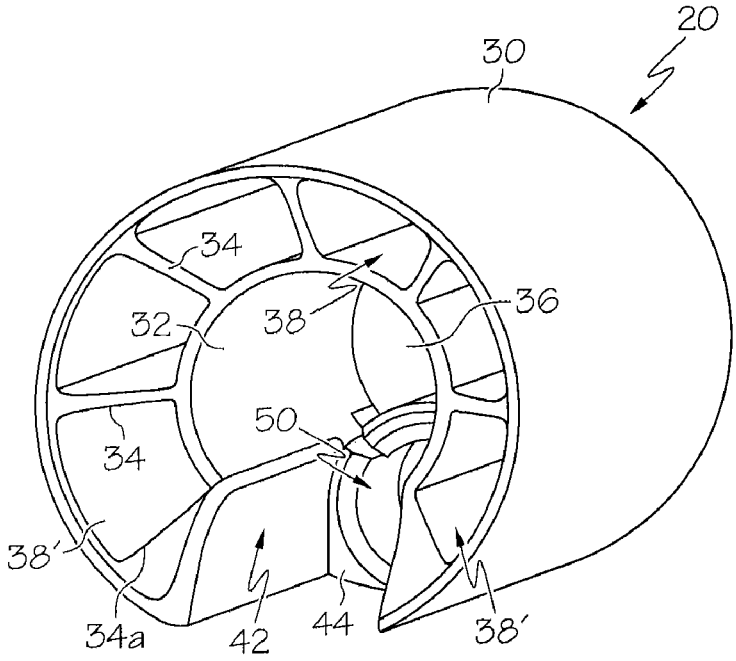
FIG. 5C is a front perspective view of the flow shaper of FIG. 5A.

As best shown in FIGS. 5A and 5C, the upstream end 34*a* of each vane 34 may be tapered such that fluid flow down the spout 12 first engages the radially outer ends of the vanes 34 and gradually engages the inner radial edges of the vanes 34. This arrangement helps to reduce pressure in the fluid and pooling of fuel along the leading edges 34*a* of the vanes 34, thereby reducing eddies and other instabilities in the flow.

With a stable stream exiting the nozzle 20, splash back of fuel onto the shut-off port 22 is reduced, thereby reducing premature and nuisance shut offs. The stable flow pattern provided by the flow shaper 20 also ensures that the cross section of an ORVR fill pipe of a vehicle being refueled is continuously covered to ensure proper operation of the ORVR system of the vehicle, which ensures, in turn, that the stage II recovery system of a refueling system (i.e., the vapor pump) is not operated improperly.

Figure 4:
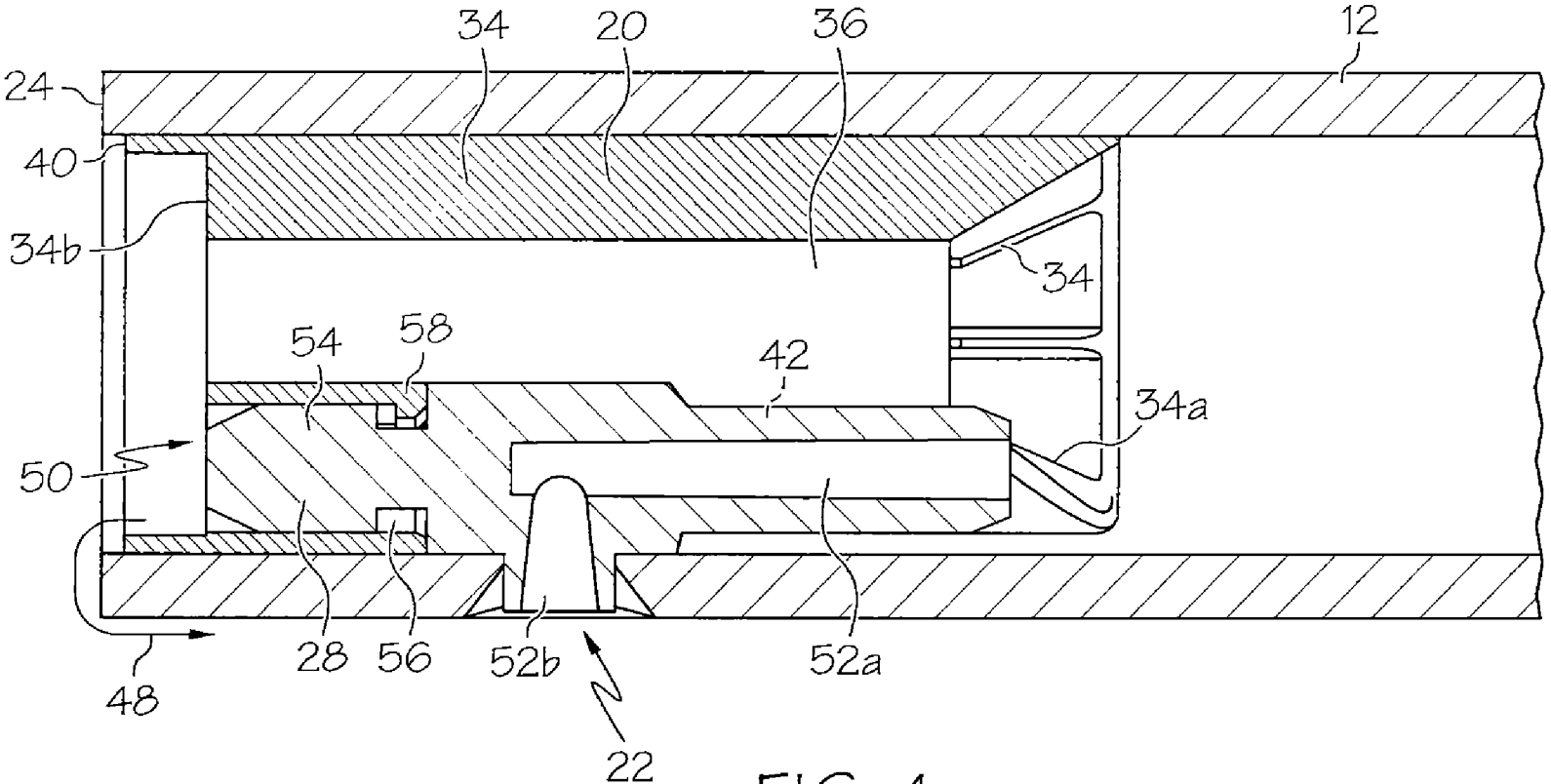
FIG. 4 is a detail view of the area indicated in FIG. 2.

The flow shaper 20 can be made of a wide variety of materials, such nearly any fuel resistant material including, but not limited to, polymers such as acetal, DELRIN® resinous plastic material sold by E.I. du Pont de Nemours and Company of Wilmington, Del., metals such as aluminum, zinc, etc. The vanes 34 and/or walls 30, 32 may be relatively thin to reduce pressure drop and may be, for example, 0.020" thick or smaller. As best shown in FIGS. 4 and 5A, the downstream end 34*b* of each vane 34 may be spaced inwardly from the downstream end 40 of the shaper 20, and the downstream end 24 of the spout 12, so that the vanes 34 are recessed and protected from breakage during use of the nozzle 10.

Figure 5D:
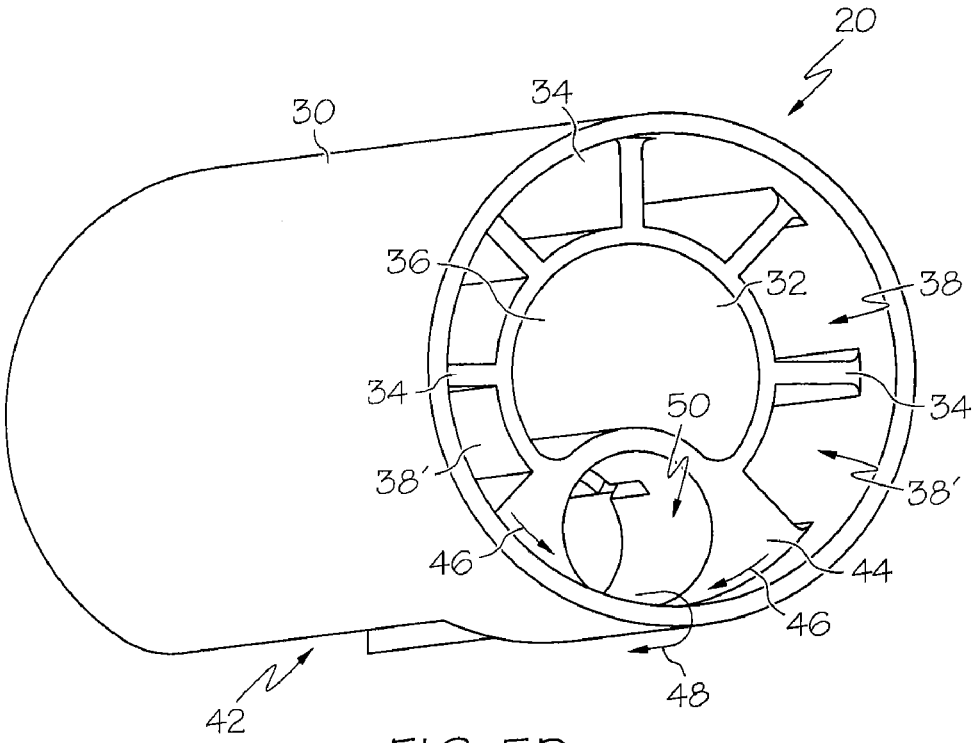
FIG. 5D is a rear perspective view of the flow shaper of FIG. 5A.

As best shown in FIGS. 5B and 5D, in one embodiment, the flow shaper 20 does not include outer cavities 38 extending around the entire perimeter (i.e., extending 360°) around the inner cavity 36. Instead, in the illustrated embodiment, the flow shaper 20 has an axially-extending cavity 42 along its bottom edge, and a wedge or spacer 44 positioned between two adjacent outer cavities 38 at one end (the downstream end) thereof, adjacent to the cavity 42. In the illustrated embodiment (as best shown in FIGS. 5B and 5D), the spacer 44 is shaped as a generally triangular component and extends about 90° around the outer perimeter of the shaper 20.

The spacer 44 helps to reduce the formation of a thin meniscus film on the underside of the spout 12. In particular, fluid from the adjacent outer cavities 38' may be prone to "creep" downwardly toward each other along the outer perimeter of the shaper 20, as shown by arrows 46 of FIG. 5D. Should these "trickle" fuel streams occur in sufficient volume, in particular in a sufficient volume to reach each other (i.e., meet at the bottom of the shaper 20), the merged trickle fuel streams 46 may curl around the lip of the shaper 20 and rise, by capillary action or otherwise, upwardly toward the sensing port 22, as shown by arrow 48 of FIG. 5D and FIG. 4.

In addition, the trickle streams 46 can merge to form a small pool or puddle at the bottom of the spout 12/shaper 20. The puddle may grow by entrapping adjacent flowing fuel due to induced drag from the puddling liquid. In addition, to the extent that there is an existing pool/puddle of liquid fuel, the fluid flowing through the channels 38' adjacent to the spacer 44 seeks to drag adjacent, pooling liquid along with it out the end of the spout 12. If fluid were to creep upwardly sufficiently, the meniscus film of fluid could reach the sensing port 22, thereby triggering an undesired automatic shut off of the nozzle 20.

However, the spacer 44 is designed to prevent such a deformation of a sufficient meniscus film. In particular, because the radially outer points of the spacer 44 are spaced apart (i.e., by about 90° in the illustrated embodiment), the spacer 44 provides significant distance between the adjacent outer cavities 38'. Thus, the spacing provided by the spacer 44 ensures that the trickle streams 46 of the cavities 38' do not merge, or if they do, are of very low volume. By sufficiently spacing the outer cavities 38', any induced drag from the adjacent fluid streams upon fluid at the bottom center of the spacer 44 is reduced. Moreover, because the adjacent outer channels 38' have a relatively high L/D ratio, velocity of the fuel through those channels 38' is increased, which causes fluid to jet out rapidly and decreases the chances of pooling.

Thus, the spacer 20 may be configured to space apart the adjacent outer cavities 38', or their radially outer edges, by at least about 90°, or at least about 60° or a distance of at least about $\pi/D4$, or at least about $\pi/D6$ of the effective diameter of the flow shaper 20. The spacer 44 is, in one embodiment, radially aligned with the sensing port 22 to reduce or minimize the generation of a film that can creep axially upwardly toward the sensing port 22. The spacer 44 can be any of a wide variety of shapes or forms, other than triangular, so long as the spacer 44 provides sufficient spacing between the outer cavities 38', and in particular, the radially outward ends of the cavities 38'. In this manner, the fuel may not be able to wick or curl around the edge of the spout 12 in sufficient volumes/velocity to reach the sensing port 22, and pooling and puddling of fuel at the bottom center of the spout 12 is minimized.

Figure 6A:
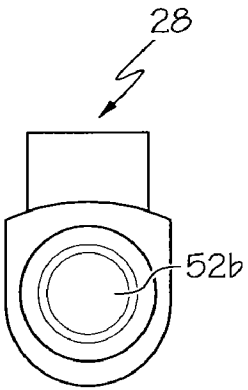
FIG. 6A is an end view of the tube insert of FIGS. 2 and 4.
Figure 6B:
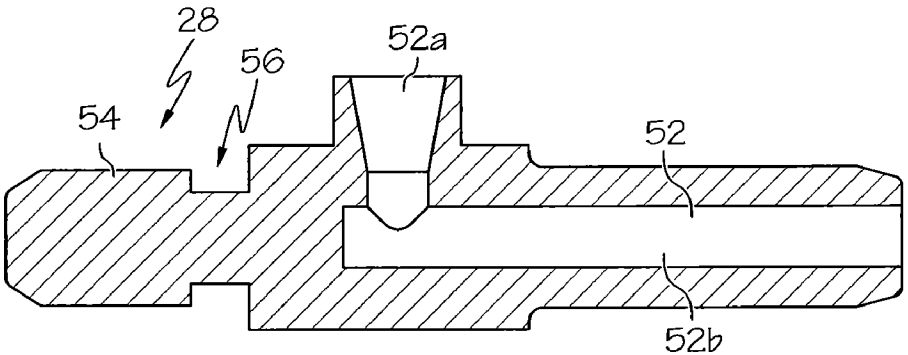
FIG. 6B is a side cross section of the tube insert of FIG. 6A.
Figure 6C:
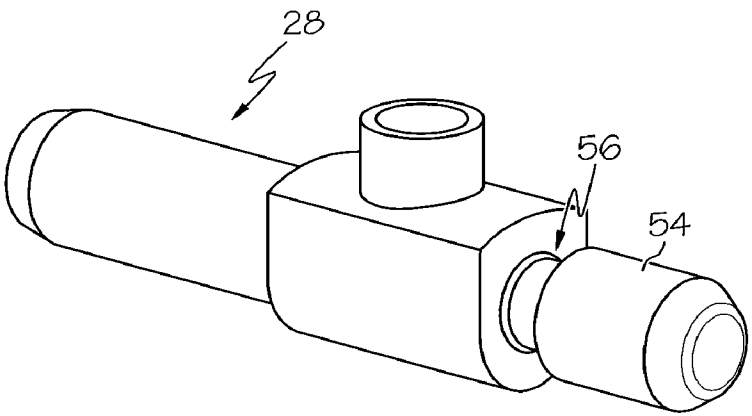
FIG. 6C is a front perspective view of the tube insert of FIG. 6A.

As shown in FIGS. 6A-6C, the tube fitting 28 includes an opening 52 formed therein having a minor portion 52*a* which extends perpendicular to the spout axis and a major portion 52*b* which extends generally parallel to the spout axis. The tube fitting 28 is received in the cavity 42 of the flow shaper 20, as shown in FIG. 4. As can be seen in FIGS. 5A-5D, the spacer 44 may include an opening 50, and the end 54 of the tube fitting 28 is received in the opening 50 of the spacer 44. The tube fitting 28, in the illustrated embodiment, has a groove 56 adjacent to the end 54 which is designed to receive a clip 58 of the flow shaper 20 therein to couple the tube fitting 28 to the flow shaper 20 (see FIG. 4).

In this manner, the distal end 54 of the tube fitting 28 fits into the opening 50 of the spacer 44, and helps to provide a generally fluid-tight spacer 44 through which fluid does not pass. However, the spacer 44 may not necessarily include the opening 50, and the tube fitting 28 may be coupled to the flow shaper 20 in any of a variety of manners. In addition, the flow shaper 20 can be retained in the spout 12 by any of a variety of means, such as by deforming the tip of the spout 12 radially inwardly or by the use of adhesives, staking, set screws, retaining rings, press fits, retaining collars, and the like other means.

After the tube fitting 28 is mounted to the flow shaper 20, and the flow shaper 20 is mounted in the spout 12, the minor portion 52*b* of the opening 52 is in direct fluid communication with, or forms part of, the sensing port 22 (see FIG. 4) and the major portion 52*a* of the opening 52*b* is in direct fluid communication with the tube 26 (see FIG. 2). In this manner, the tube fitting 28 allows the pressure from the sensing port 22 to be communicated, via the tube 26, to the shut off circuit.

It should be noted that some previous arrangements for coupling the tube 26 to the sensing port 22 may provide an obstruction to flow which generates significant turbulence in the stream of fuel. However, in the flow shaper 20 disclosed herein, not only does the spacer 44 provide the function of reducing meniscus films which can cover the sensing port 22, but the spacer 44 also makes use of, and is aligned with, the tube fitting 28 so that the tube fitting 28 does not contribute additional turbulence. In other words, the flow shaper 20 incorporates what is otherwise a mere obstruction in the fuel path into a functional arrangement.

Figure 7:
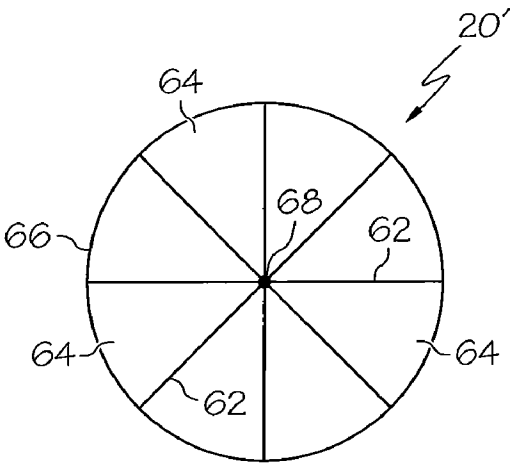
FIG. 7 is an end view of another embodiment of the flow shaper.

FIG. 7 illustrates another embodiment of the fuel shaper 20'. In this case, the fuel shaper 20' has an outer wall 60, and a plurality of vanes 62 that divider the fuel shaper 20' into a plurality of cavities 64. In the illustrated embodiment, the outer wall 60 is generally cylindrical (although the outer wall 60 can be shaped as desired to conform to the inner surface of the spout 12), and the vanes 62 are generally radially positioned and meet at the axial center of the fuel shaper 20'.

In this case, the flow shaper 20' has a plurality of cavities 64, each of which radially extends across generally the entire effective cross section thereof of the flow shaper 20' (i.e. from the outer wall 66 to an inner section 68 which does not allow fluid flow therethrough). In this embodiment, each of the cavities 64 may have a sufficient L/D ratio (i.e. about 10:1 in one case) such that the flow exiting each cavity 64 is fully developed. This, any of a variety of shapes and configurations for the flow shaper, vanes, and cavities may be used, and it may be desired that at least the majority of the outer perimeter of an exiting fluid stream be fully developed.

Having described the invention in detail and by reference to the various embodiments, it should be understood that modifications and variations thereof are possible without departing from the scope of the invention.

What is claimed is:

1. A fuel dispensing nozzle system comprising:

a spout configured to dispense fuel flowing therethrough; and a flow shaper positioned in said spout such that fuel flowing through said spout passes through said flow shaper, said flow shaper including a central cavity and a plurality of outer cavities positioned about said central cavity, said central cavity and said plurality of outer cavities each having a L/D ratio, wherein said L/D ratio of said central cavity is less than the L/D ratio of each of said outer cavities.

2. The system of claim 1 wherein said central cavity is entirely spaced away from an inner wall of said spout.

3. The system of claim 1 wherein said plurality of outer cavities extend radially around the majority of an outer perimeter of the central cavity.

4. The system of claim 1 wherein said flow shaper includes an outer wall and an inner wall entirely radially spaced away from said outer wall, said outer wall being positioned adjacent said spout, said inner wall defining said central cavity, said flow shaper further including a plurality of vanes extending generally radially between said inner wall and said outer wall, wherein said inner wall, said outer wall, and said vanes define said plurality of outer cavities.

5. The system of claim 4 wherein an upstream end of each vane is tapered with respect to a direction of fluid flow through said spout.

6. The system of claim 1 wherein each L/D ratio for any given cavity is the ratio of the length of the given cavity to the hydraulic diameter of the given cavity, and wherein an outer surface of said flow shaper is generally cylindrical.

7. The system of claim 1 wherein the L/D ratio for each of the plurality of outer cavities is sufficient to provide generally fully developed fluid flow of fuel exiting each outer cavity.

8. The system of claim 7 wherein said generally fully developed flow is flow wherein viscous effects from a surface defining each cavity effects generally all fuel exiting that cavity.

9. The system of claim 7 wherein the L/D ratio for said central cavity is insufficient to provide generally fully developed fluid flow of fuel exiting said central cavity.

10. The system of claim 7 further comprising liquid fuel flowing through said spout and said central cavity and said plurality of outer cavities of said flow shaper in generally the same axial direction such that the flow of fuel exiting each outer cavity is fully developed.

11. The system of claim 1 wherein the L/D ratio for each of the plurality of outer cavities is at least about 10:1.

12. The system of claim 1 wherein said flow shaper includes a spacer which does not allow the flow of fuel therethrough, wherein said spacer has an outer portion positioned adjacent to said spout and between at least two adjacent outer cavities, wherein said outer portion extends at least about 60 degrees.

13. The system of claim 12 wherein said spout includes a shut-off opening formed therein, and wherein said spacer is generally radially aligned with said shut-off opening.

14. The system of claim 1 further comprising a fuel reservoir and a hose fluidly coupled to a nozzle including said spout and said fuel reservoir, and a pump configured to pump fuel from said fuel reservoir, through said hose, to said nozzle and through said fuel shaper.

15. The system of claim 1 wherein said flow shaper is positioned at a distal end of said spout.

16. The system of claim 1 wherein each cavity is configured to receive flow therethrough in generally the same axial direction.

17. The system of claim 1 wherein said central cavity extends entirely through said shaper from an upstream end of said flow shaper to a downstream end thereof.

18. The system of claim 1 wherein said central cavity is defined by a generally tubular wall having a central opening extending entirely axially through said tubular wall such that said tubular wall is open at each axial end.

19. The system of claim 1 wherein said central cavity has about the same axial length as each of said plurality of outer cavities.

* * * * *